US010184696B2

(12) United States Patent
Wang et al.

(10) Patent No.: US 10,184,696 B2
(45) Date of Patent: Jan. 22, 2019

(54) COLD REGENERATIVE AIR CONDITIONING APPARATUS

(71) Applicant: NANJING RECLAIMER ENVIRONMENTAL TEKNIK CO., LTD, Nanjing, Jiangsu (CN)

(72) Inventors: Haibo Wang, Jiangsu (CN); Xiaobin Sui, Jiangsu (CN); Bin Liang, Jiangsu (CN); Lin Ding, Jiangsu (CN)

(73) Assignee: NANJING RECLAIMER ENVIRONMENTAL TEKNIK CO., LTD, Nanjing, Jiangsu (CN)

( * ) Notice: Subject to any disclaimer, the term of this patent is extended or adjusted under 35 U.S.C. 154(b) by 614 days.

(21) Appl. No.: 14/785,186

(22) PCT Filed: Jan. 24, 2014

(86) PCT No.: PCT/CN2014/071357
§ 371 (c)(1),
(2) Date: Oct. 16, 2015

(87) PCT Pub. No.: WO2014/180176
PCT Pub. Date: Nov. 13, 2014

(65) Prior Publication Data

US 2016/0069594 A1 Mar. 10, 2016

(30) Foreign Application Priority Data

May 7, 2013 (CN) ..... 2013 1 0165635

(51) Int. Cl.
*F25B 13/00* (2006.01)

(52) U.S. Cl.
CPC ..... *F25B 13/00* (2013.01); *F25B 2313/027* (2013.01); *F25B 2313/02742* (2013.01); *F25B 2400/05* (2013.01)

(58) Field of Classification Search
CPC ..... F25B 2400/05; F25B 2400/051; F25B 2400/052; F25B 2400/053;
(Continued)

(56) References Cited

FOREIGN PATENT DOCUMENTS

CN 2499764 Y 7/2002
CN 203240691 U 10/2013
(Continued)

*Primary Examiner* — Orlando E Aviles
(74) *Attorney, Agent, or Firm* — Novick, Kim & Lee, PLLC; Allen Xue

(57) ABSTRACT

An air conditioning apparatus includes a refrigerant tank, a cryogenic liquid pump, a condensing evaporator, a compressor, a user system, a throttle valve, a first reversing valve, and a second reversing valve. It operates in two modes. In the first mode, the refrigerant in the refrigerant tank flows sequentially from the refrigerant tank, the cryogenic liquid pump, the condensing evaporator, the first reversing valve, the compressor, the second reversing valve, the user system, the first reversing valve, the second reversing valve, the condensing evaporator, the throttle valve, and back to the refrigerant tank. In the second mode, refrigerant in the refrigerant tank flows sequentially from the refrigerant tank, the cryogenic liquid pump, the condensing evaporator, the first reversing valve, the second reversing valve, the user system, the first reversing valve, the compressor, the second reversing valve, the condensing evaporator, the throttle valve, and back to the refrigerant tank.

7 Claims, 2 Drawing Sheets

(58) Field of Classification Search
CPC ..... F25B 2400/054; F25B 2400/13; F25B 2400/17; F25B 2313/02742; F25B 2313/027
See application file for complete search history.

(56) References Cited

FOREIGN PATENT DOCUMENTS

| | | | |
|---|---|---|---|
| EP | 1457744 | A2 | 9/2004 |
| JP | 2005-016897 | A | 1/2005 |
| KR | 10-2012-0022203 | A | 3/2012 |

COLD REGENERATIVE AIR CONDITIONING APPARATUS

TECHNICAL FIELD

This invention is about a cold regenerative air conditioning apparatus, specifically it falls into the technical field of air conditioning.

BACKGROUND OF THE INVENTION

The traditional heat pump theoretical basis is originated from the discovery by Carnot in the early 19th century, and he published an essay about Carnot cycle in 1824. In 1852, Thomson put forth the first time his envisage of heat pump with air as working medium; and in 1854, Kelvin stated that a refrigerating apparatus could be used for heating. In the 1870s, refrigerating equipment based on Carnot principle developed rapidly, however, the development of heat pump lagged far behind. The world energy crisis in 1973 made all countries in Europe as well as the Soviet Union, Japan, the United States and Australia attach great importance to the work on heat pump. Today, all countries in the world are becoming increasingly interested in heat pump, and the manufacturers in Europe, Japan and North America have supplied many heat pumps for industries, commerce, building and civilian applications. International organizations, such as the International Energy Agency and European Community, have worked out development programs for large heat pumps, the testing of many new technologies and the popularization and application of existing heat pump technologies in new fields are going on or under planning, and the applications of heat pump are daily widening. Heat pumps are playing a daily increasing important role in energy conservation.

A traditional heat pump takes up heat from the surrounding environment, and transfers it to the object to be heated up, it follows the same working principle as a refrigerator as the reverse cycle of a heat machine, with the only difference in working temperature range. In some industrial sectors requiring heat supply and refrigerating at the same time, such as meat processing, food and dairy processing, the use of heat pump apparatuses for comprehensive cold and heat supplies is more economic and rational.

In a heat pump type household air conditioner used in winter, the massive cold obtained in the circulation of the refrigerator is only used to absorb the waste heat from the surrounding environment by the outdoor evaporator, and this is actually a great waste; for heating in winter with low ambient temperature, high humidity and in damp and rainy weather, the heating efficiency decreases seriously with ordinary air source heat pump air conditioners available on market, and they sometimes even cannot start up and work normally; therefore, in the north of China where it is quite cold in winter, ordinary air source heat pump air conditioners can only be used in transitional seasons, and they basically cannot meet the heating demand in cold winter. It is known to all that in the north of China, the traditional centralized heating is mainly by burning coal and gas, and such heating form cannot meet the requirements of social development in energy conservation, environmental protection or safety. Therefore, it is necessary to develop heat pump air conditioners that can function normally in winter with severe cold, and the corresponding auxiliary equipment and systems should also be provided.

The traditional refrigerating theory is mainly based on thermodynamics, i.e. Carnot reverse cycle of identical temperature difference is used to analyze the refrigerating cycle process, the economic indicator of the refrigerating cycle is the refrigeration coefficient, or the ratio of obtained gain to the cost of consumption, and also, of all refrigerating cycles between atmospheric environment with temperature for $T_0$ and low temperature heat source with temperature of Tc (such as refrigeration store), the reverse Carnot cycle has the highest refrigeration coefficient:

$$\varepsilon_c = (COP)_{R,C} = \frac{q_2}{w_0} = \frac{T_c}{T_0 - T_c} \tag{1}$$

In the formula above, $\varepsilon_c$ is the refrigeration coefficient, $q_2$ refrigerating capacity of the cycle, and $w_0$ the net work consumed by the cycle.

In fact, in his thesis "Reflections on the Motive Power of Heat", Carnot concluded that: of all heat engines working between two constant temperature heat sources of different temperatures, the reversible heat engine has the highest efficiency." This was later referred to as the Carnot theorem, after rearranging with the ideal gas state equation, the thermal efficiency of Carnot cycle obtained is:

$$\eta_c = 1 - \frac{T_2}{T_1} \tag{2}$$

In Formula (2), temperature $T_1$ of the high temperature heat source and temperature $T_2$ of low temperature heat source are both higher than the atmosphere ambient temperature $T_0$, and the following important conclusions can be obtained:

1) The thermal efficiency of Carnot cycle only depends on the temperature of high temperature heat source and low temperature heat source, or the temperature at which the media absorbs heat and release heat, therefore the thermal efficiency can be increased by increasing $T_1$ and decreasing $T_2$.

2) The thermal efficiency of Carnot cycle can only be less than 1, and can never be equal to 1, because it is not possible to realize $T_1=\infty$ or $T_2=0$. This means that a cyclic engine, even under an ideal condition, cannot convert all thermal energy into mechanical energy, of course, it is even less possible that the thermal efficiency is greater than 1.

3) When $T_1=T_2$, the thermal efficiency of the cycle is equal to 0, it indicates that in a system of balanced temperature, it is not possible to convert heat energy into mechanical energy, heat energy can produce power only with a certain temperature difference as a thermodynamic condition, therefore it has verified that it is not possible to build a machine to make continuous power with a single heat source, or the perpetual motion machine of the second kind does not exist.

4) Carnot cycle and its thermal efficiency formula are of important significance in the development of thermodynamics. First, it laid the theoretical foundation for the second law of thermodynamics; secondly, the research of Carnot cycle made clear the direction to raise the efficiency of various heat power engines, i.e. increasing the heat absorbing temperature of media and lowering the heat release temperature of media as much as possible, so that the heat is release at the lowest temperature that can be naturally obtained, or at the atmospheric temperature. The method to increase the gas heat absorbing temperature by adiabatic compression is still a general practice in heat engines with gas as media today.

5) The limit point of Carnot cycle is atmospheric ambient temperature, and for refrigerating process cycles below ambient temperature, Carnot cycle has provided no definite answer.

Because of the incompleteness of refrigeration coefficient, many scholars at home and abroad conducted research on it, and proposed methods to further improve it. In "Research on Energy Efficiency Standard of Refrigerating and Heat Pump Products and Analysis of Consummating Degree of Cyclic Thermodynamics", Ma Yitai et al, in conjunction with the analysis of introduction of the irreversible process of heat transfer with temperature difference into heat cycle by Curzon and Ahlborn and the enlightenment from the finite time thermodynamics created on it, as well as the CA cycle efficiency, proposed the consummating degree of thermodynamics, advancing to a certain extent the energy efficiency research on the refrigerating and heat pump products.

However, the basic theory of thermodynamics cannot make simple, clear and intuitional explanation of the refrigerating cycle. Einstein commented the classical thermodynamics this way: "A theory will give deeper impression to the people with simpler prerequisite, more involvement and wider scope of application." In the theoretical interpretation in the refrigeration field, this point should be inherited and carried forward.

Therefore, it has become a difficult point in the research in air conditioning refrigerating field to really find a correct theoretical foundation of refrigerating cycle, propose a new cold regenerative air conditioning apparatus on this theoretical foundation and apply it in practice, to effectively increase the conversion efficiency of air conditioning apparatuses in refrigerating in summer and heating in winter.

CONTENT OF THE INVENTION

The purpose of this invention is to improve the completeness of applying Carnot theorem to analysis of heat pump type air conditioning theory, propose a refrigerating theory corresponding to thermodynamic theory, or cold dynamics theory, and also apply this theory in designing a new cold regenerative air conditioning apparatus.

The basic formula describing the cold dynamic theory is:

$$\eta_c = 1 - \frac{T_{c2}}{T_{c1}} \tag{3}$$

In Formula (3), $Tc2<Tc1<T_0$, $T_0$ is the ambient temperature, all based on Kelvin temperature scale.

With respect to the ambient temperature $T_0$, the maximum cold efficiency of the cold source at Tc1 and Tc2 is:

$$\eta_c = 1 - \frac{T_{c1}}{T_0} \tag{4}$$

$$\eta_c = 1 - \frac{T_{c2}}{T_0} \tag{5}$$

Suppose $q_2$ is the refrigerating capacity of the cycle, and $w_0$ the net power consumed by the cycle, then when the cold source temperature is Tc1:

$$w_0 = \left(1 - \frac{T_{c1}}{T_0}\right)q_2 \tag{6}$$

Similarly, when the cold source temperature is $Tc_2$:

$$w_0 = \left(1 - \frac{T_{c2}}{T_0}\right)q_2 \tag{7}$$

It is not difficult to see from Formulas (4) to (7) that, the efficiency of the cold dynamics is between 0 and 1, and due to unavoidable irreversibility in the actual process, the refrigerating cycle efficiency is less than 1; when the ambient temperature $T_0$ is determined, the lower cold source temperature, the more refrigerating capacity can be obtained with the same amount of work input, and this has pointed out the direction for building new refrigerating cycle, or high efficiency electric power and cold energy conversion.

$$\eta_c = 1 - \sqrt{\frac{T_{c1}}{T_0}} \tag{8}$$

Suppose the heat supply average temperature of a heat pump is $T_1$, the heat quantity supplied $Q_0$, ambient temperature $T_0$, cold end average endothermic temperature $T_c$ and quantity of heat taken $Q_2$, then the theoretical efficiency of a heat pump is:

$$\eta = \frac{\left(1 - \frac{T_0}{T_1}\right)Q_0 + \left(1 - \frac{T_c}{T_0}\right)Q_2}{W} \tag{9}$$

Considering the viewpoint of finite time cold dynamics, the improved heat pump efficiency formula is:

$$\eta = \frac{\left(1 - \sqrt{\frac{T_0}{T_1}}\right)Q_0 + \left(1 - \sqrt{\frac{T_c}{T_0}}\right)Q_2}{W} \tag{10}$$

On the basis of the above-mentioned basic principle, this invention has proposed a air conditioning apparatus different from the traditional ones, a cold regenerator is used to recover the cold energy generated from compressing the gaseous refrigerant, so as to increase the circulation efficiency of the air conditioning apparatus, so that the proposed cold dynamics theory becomes a preliminarily completed theoretical system that can really guide the development practice of air conditioning technology.

The purpose of this invention is realized with the following measure: a cold regenerative air conditioning apparatus, comprising of a heat supply circulation circuit and a refrigerating circulation circuit, with the features that:

The said heat supply cycle of the cold regenerative air conditioning apparatus refers to that the liquid refrigerant 2 coming out from refrigerant tank 1, after boosting by cryogenic liquid pump 3, is sent into condensing evaporator 9, to transfer the cold energy to the backflow refrigerant at a higher temperature, to release cold energy, the gaseous refrigerant at increased temperature, after increasing pressure and temperature via compressor 5, is sent to user system 6 to supply heat; the refrigerant gas coming out from user system 6 enters the condensing evaporator 9, to recover cold energy and reduce temperature, and returns via throttle valve 10 to the refrigerant tank 1, the heat supply circulation circuit recovers and utilizes at high efficiency the refrigerating capacity produced by boosting by compressor 5, so as to complete the heat supply circulation circuit of the cold regenerative air conditioning apparatus;

The refrigerating cycle of the said cold regenerative air conditioning apparatus, refers to that the liquid refrigerant 2 coming out from refrigerant tank 1, after boosting by cryogenic liquid pump 3, is sent into condensing evaporator 9, to transfer the cold energy to the backflow refrigerant at a higher temperature, to release cold energy, the heated up refrigerant is sent to the user system 6 to supply cold; the refrigerant gas coming out from user system 6, after being compressed by compressor 5, enters the condensing evaporator 9, to recover cold energy and reduce temperature, and returns via throttle valve 10 to the refrigerant tank 1, so as to complete the cold supply circulation circuit of the cold regenerative air conditioning apparatus.

The afore-said cold regenerative air conditioning apparatus, with the further feature that it is provided with reversing valve 7 and reversing valve 8: liquid refrigerant 2 coming out from refrigerant tank 1, after boosting by cryogenic liquid pump 3, is sent into condensing evaporator 9, to transfer the cold energy to the backflow refrigerant at a higher temperature, to release cold energy, the gaseous refrigerant at increased temperature flows via be channel of reversing valve 7→compressor 5→fe channel of reversing valve 8→user system 6→da channel of reversing valve 7→hg channel of reversing valve 8, enters the condensing evaporator 9, to recover cold energy and reduce temperature, via throttle valve 10 and returns to the refrigerant tank 1, so as to complete the heat supply circulation circuit of the cold regenerative air conditioning apparatus;

The liquid refrigerant 2 coming out from refrigerant tank 1, after boosting by cryogenic liquid pump 3, is sent into condensing evaporator 9, to transfer the cold energy to the backflow refrigerant at a higher temperature, to release cold energy, the gaseous refrigerant at increased temperature flows via ba channel of reversing valve 7→he channel of reversing valve 8→user system 6→dc channel of reversing valve 7→compressor 5→fg channel of reversing valve 8, enters the condensing evaporator 9, to recover cold energy and reduce temperature, via throttle valve 10 and returns to the refrigerant tank 1, so as to complete the cold supply circulation circuit of the cold regenerative air conditioning apparatus.

It is provided with cold exchanger 4: the liquid refrigerant 2 coming out from refrigerant tank 1, after boosting by cryogenic liquid pump 3, flows via condensing evaporator 9 and cold exchanger 4, to transfer the cold energy to the backflow refrigerant at a higher temperature, to release cold energy, the gaseous refrigerant at increased temperature flows via be channel of reversing valve 7→compressor 5→fe channel of reversing valve 8→user system 6→da channel of reversing valve 7→hg channel of reversing valve 8, enters the cold exchanger 4 and condensing evaporator 9, then returns via throttle valve 10 to the refrigerant tank 1, so as to complete the heat supply circulation circuit of the cold regenerative air conditioning apparatus;

The liquid refrigerant 2 coming out from refrigerant tank 1, after boosting by cryogenic liquid pump 3, is sent via condensing evaporator 9 into cold exchanger 4, to transfer the cold energy to the backflow refrigerant at a higher temperature, to release cold energy, the gaseous refrigerant at increased temperature flows via ba channel of reversing valve 7→he channel of reversing valve 8→user system 6→dc channel of reversing valve 7→compressor 5→fg channel of reversing valve 8, enters the cold exchanger 4 and condensing evaporator 9, and then returns via throttle valve 10 to the refrigerant tank 1, so as to complete the cold supply circulation circuit of the cold regenerative air conditioning apparatus.

The said cold exchanger 4 is provided with necessary provisions to enhance heat transfer, such as increased fins, plate-fin heat exchanger, micro channel heat exchanger, and the cold exchange medium in said cold exchanger 4 works in an indirect cold transfer mode.

The variable frequency speed regulation device can be used for the said compressor 5.

Other structures not mentioned in the cold regenerative air conditioning apparatus of this invention are not described in detail, and are all designed with existing mature technologies.

The said refrigerant tank 1 shall be provided with necessary thermal and cold insulation, such as thermal isolated vacuum container, and insulation materials such as pearlite.

The equipment and their backup systems, pipes, instruments, valves, cold insulation and bypass facilities with regulation functions not described in this invention shall be configured with generally known mature technologies.

Safety and regulation and control facilities associated with the cold regenerative air conditioning apparatus of this invention are provided, so that the apparatus can operate economically and safely with high thermal efficiency, to achieve the goal of energy conservation, consumption reduction and environmental protection.

This invention has the following advantages as compared with existing technologies:

1. The evaporator and condenser for refrigerating or heating purpose are in an integrated structure. Compared with a traditional air conditioning apparatus, the condenser and evaporator in the heating and refrigerating cycles are not affected by external environmental factors, when the compressor compresses the refrigerant to supply heat, the refrigerating energy produced from the refrigerant gas in compression can be effectively recovered, which is a breakthrough to the traditional air conditioning technology.

2. It needs not to use outdoor equipment as in traditional air conditioning, without impact to the environment, so it can effectively avoid the hot island effect of residents and office buildings in cities, the installation is convenient, easy and safe, the process flow is simpler, better complying with the principle of energy conservation and environmental protection.

3. The maintenance work quantity of equipment has been greatly reduced as compared with traditional air conditioning apparatuses, cleaning can be done easily for the integrated evaporator (condenser) for heating and refrigerating, to effectively improve the heat exchange effect, and greatly extend the service life of the whole apparatus.

4. Enhanced cold transfer and heat transfer: as compared with traditional air conditioning apparatuses, cold transfer elements can be conveniently used and enhanced, for higher efficiency of air conditioning apparatus. There will be substantial economic, social and environmental protection benefits, a breakthrough to the traditional air conditioning technology.

DESCRIPTION OF FIGURES

In FIG. 1: 1—evaporator, 2—filter, 3—capillary, 4—filter, 5—condenser, 6—reversing valve, 7—gas-liquid separator, 8—compressor.

In FIG. 2: 1—refrigerant tank, 2—liquid refrigerant, 3—cryogenic liquid pump, 3-1—cold exchanger inlet pipeline, 4—cold exchanger, 5—compressor, 6—user system, 7—reversing valve, 8—reversing valve, 9—condensing evaporator, 10—throttle valve.

In FIG. 3: 1—refrigerant tank, 2—liquid refrigerant, 3—cryogenic liquid pump, 3-1—cold exchanger inlet pipeline, 4—cold exchanger, 5—compressor, 6—user system, 7—reversing valve, 8—reversing valve, 9—condensing evaporator, 10—throttle valve.

EMBODIMENTS

In the following, this invention is further described in detail in conjunction with figures and embodiments.

Embodiment 1

Figure 1:
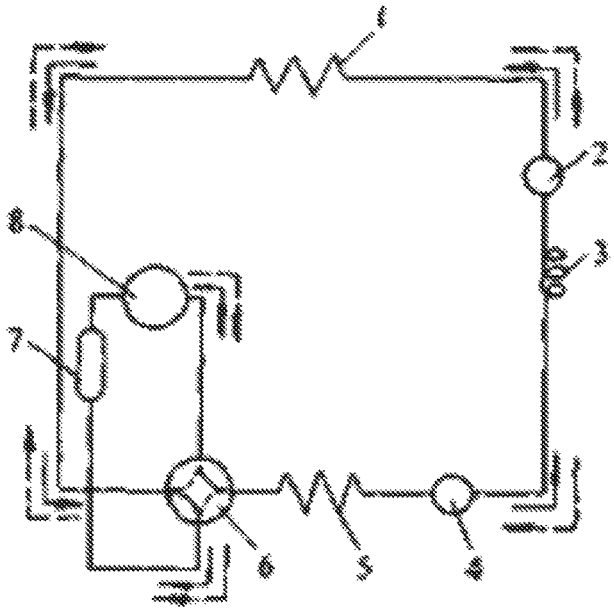
Prior Art Figure 1
FIG. 1 is a process schematic diagram of a heat pump type air conditioner of the existing technology.
Figure 2:
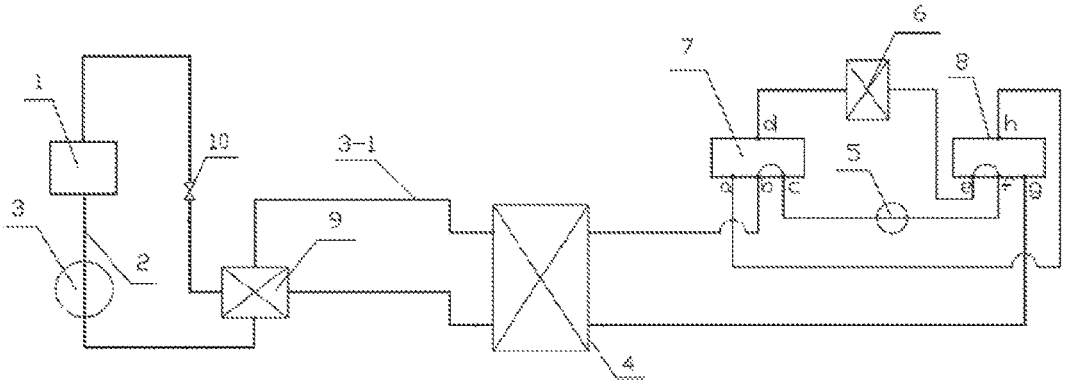
FIG. 2 is the schematic diagram of the heating process of a regenerative air conditioning apparatus of this invention.
Figure 3:
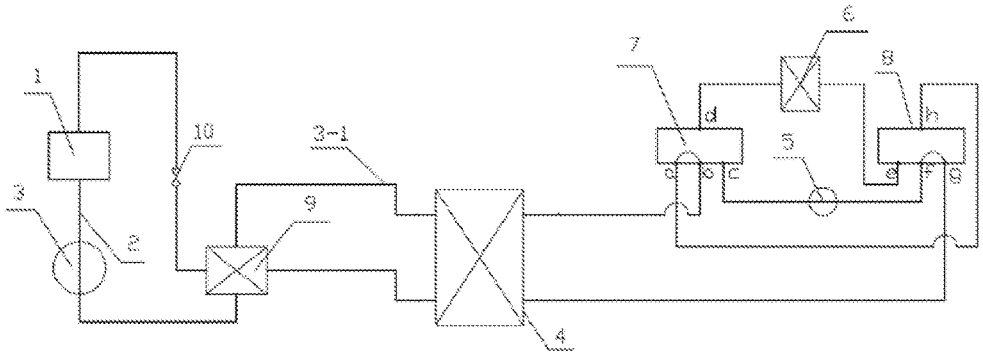
FIG. 3 is the schematic diagram of the refrigerating process of a regenerative air conditioning apparatus of this invention.

As shown in FIG. 2 and FIG. 3, a cold regenerative air conditioning apparatus, comprising of a heat supply circulation circuit and a cold supply circulation circuit, with the embodiment as follows.

The liquid refrigerant 2 coming out from refrigerant tank 1, after boosting by cryogenic liquid pump 3, it is sent via condensing evaporator 9 into cold exchanger 4, to transfer the cold energy to the backflow refrigerant at a higher temperature, to release cold energy, the gaseous refrigerant at increased temperature flows via be channel of reversing valve 7→compressor 5→fe channel of reversing valve 8→user system 6→da channel of reversing valve 7→hg channel of reversing valve 8, enters the cold exchanger 4 and condensing evaporator 9, then flows via throttle valve 10 and returns to the refrigerant tank 1, so as to complete the heat supply circulation circuit of the cold regenerative air conditioning apparatus;

The liquid refrigerant 2 coming out from refrigerant tank 1, after boosting by cryogenic liquid pump 3, is sent via condensing evaporator 9 into cold exchanger 4, to transfer the cold energy to the backflow refrigerant at a higher temperature, to release cold energy, the gaseous refrigerant at increased temperature flows via ba channel of reversing valve 7→he channel of reversing valve 8→user system 6→dc channel of reversing valve 7→compressor 5→fg channel of reversing valve 8, enters the cold exchanger 4 and condensing evaporator 9, and then returns via throttle valve 10 to the refrigerant tank 1, so as to complete the cold supply circulation circuit of the cold regenerative air conditioning apparatus.

The said cold exchanger 4 is provided with necessary provisions to enhance heat transfer, such as increased fins, plate-fin heat exchanger, micro channel heat exchanger, and the cold exchange medium in said cold exchanger 4 works in an indirect cold transfer mode.

The variable frequency speed regulation device can be used for the said compressor 5.

Other structures not mentioned in the cold regenerative air conditioning apparatus of this invention are not described in detail, and are all designed with existing mature technologies.

The said refrigerant tank 1 shall be provided with necessary thermal and cold insulation, such as thermal isolated vacuum container, and insulation materials such as pearlite.

The equipment and their backup systems, pipes, instruments, valves, cold insulation and bypass facilities with regulation functions not described in this invention shall be configured with generally known mature technologies.

Safety and regulation and control facilities associated with the cold regenerative air conditioning apparatus of this invention are provided, so that the apparatus can operate economically and safely with high thermal efficiency, to achieve the goal of energy conservation, consumption reduction and environmental protection.

This invention has been made public with an optimum embodiment as above, however, it is not used to restrict this invention, all variations or decorations made by those familiar with this technology without deviating from the spirit and scope of this invention also falls into the scope of protection of this invention. Therefore, the scope of protection of this invention shall be that defined by the claims in this application.

The invention claimed is:

1. A cold regenerative air conditioning apparatus, comprising a refrigerant, a refrigerant tank, a cryogenic liquid pump, a condensing evaporator, a compressor, a user system, a throttle valve, a first reversing valve, and a second reversing valve, wherein the first reversing valve and the second reversing valve operate to form a first circuit of the refrigerant flow or a second circuit of the refrigerant flow, wherein the first circuit is configured such that during operation the refrigerant in the refrigerant tank flows sequentially from the refrigerant tank, the cryogenic liquid pump, the condensing evaporator, the first reversing valve, the compressor, the second reversing valve, the user system, the first reversing valve, the second reversing valve, the condensing evaporator, the throttle valve, and back to the refrigerant tank, wherein the second circuit is configured such that during operation the refrigerant in the refrigerant tank flows sequentially from the refrigerant tank, the cryogenic liquid pump, the condensing evaporator, the first reversing valve, the second reversing valve, the user system, the first reversing valve, the compressor, the second reversing valve, the condensing evaporator, the throttle valve, and back to the refrigerant tank.

2. The apparatus of claim 1, wherein each of the first reversing valve and the second reversing valve has a first inlet, a second inlet, a first outlet, and a second outlet, wherein, in the first circuit, the refrigerant sequentially passes the first inlet of the first reversing valve, the first outlet of the first reversing valve, the compressor, the first inlet of the second reversing valve, the second outlet of the second reversing valve, the user system, the second inlet of the first reversing valve, the second outlet of the first reversing valve, the second inlet of the second reversing valve, and the first outlet of the second reversing valve.

3. The apparatus of claim 2, wherein, in the second circuit, the refrigerant sequentially passes the first inlet of the first reversing valve, the second outlet of the first reversing valve, the second inlet of the second reversing valve, the second outlet of the second reversing valve, the user system, the second inlet of the first reversing valve, the first outlet of the first reversing valve, the compressor, the first inlet of the second reversing valve, and the first outlet of the second reversing valve.

4. The apparatus of claim 1, further comprising a cold exchanger have a first inlet, a second inlet, a first outlet, and a second outlet, wherein the first outlet of the cold exchanger is connected to the first inlet of the first reversing valve, and the second inlet of the cold exchanger is connected to the first outlet of the second reversing valve.

5. The apparatus of claim 4, wherein the refrigerant from the cryogenic liquid pump and the refrigerant from the colder exchanger exchange heat in the condensing evaporator.

6. The apparatus of claim 5, wherein the refrigerant from the condensing evaporator and the refrigerant from the first outlet of the second reversing valve exchange heat in the cold exchanger.

7. The apparatus of claim 1, wherein the compressor comprises a variable frequency speed regulation device.

* * * * *